US007597080B1

(12) United States Patent
Liu

(10) Patent No.: US 7,597,080 B1
(45) Date of Patent: Oct. 6, 2009

(54) ENGINE FOR A RADIO CONTROL MODEL

(76) Inventor: Nai Wen Liu, 5F.-2, No.212, Sec. 1, Wunsin Rd., Taichung City (408) (TW)

( * ) Notice: Subject to any disclaimer, the term of this patent is extended or adjusted under 35 U.S.C. 154(b) by 0 days.

(21) Appl. No.: 12/313,362

(22) Filed: Nov. 20, 2008

(30) Foreign Application Priority Data

Jul. 4, 2008 (TW) ..... 97211894 U

(51) Int. Cl.
*F02N 11/12* (2006.01)
*F02N 11/14* (2006.01)
*F02P 19/02* (2006.01)

(52) U.S. Cl. ..... 123/179.27; 123/DIG. 3; 123/179.6

(58) Field of Classification Search ..... 123/179.27, 123/DIG. 3, 179.28, 179.24, 179.5, 179.6, 123/179.2
See application file for complete search history.

(56) References Cited

U.S. PATENT DOCUMENTS 5,367,995 A * 11/1994 Kondo ..... 123/179.6
6,276,325 B1 * 8/2001 Arlton ..... 123/DIG. 3
6,691,660 B2 * 2/2004 Silva et al. ..... 123/179.6
6,692,334 B2 * 2/2004 Lu ..... 446/454
6,837,202 B1 * 1/2005 Lu ..... 123/179.27
6,997,155 B1 * 2/2006 Lu ..... 123/179.25
7,138,908 B2 * 11/2006 Lu ..... 123/179.25
2003/0079706 A1 * 5/2003 Muehlbauer ..... 123/179.25

* cited by examiner

*Primary Examiner*—Stephen K Cronin
*Assistant Examiner*—Arnold Castro

(57) ABSTRACT

An engine for a radio control model includes an input axle partially extending out of the engine. A drive device is laterally mounted to the engine for driving the input axle when starting the engine. The driving device includes a first casing and a second casing abutting each other and respectively made of insulating material. At least one drive element is rotatably mounted in the driving device for driving the input axle. A polygonal hole is longitudinally defined in the at least one drive element and adapted to be connected to an extra power source. A conducting ring is sleeved on the at least one drive element and a wire is electrically connected to the conducting ring and a spark plug that is mounted in the engine such that the spark plug sparkles and the input axle provides torsion at the same time for starting the engine.

5 Claims, 6 Drawing Sheets

ENGINE FOR A RADIO CONTROL MODEL

BACKGROUND OF THE INVENTION

1. Field of the Invention

The present invention relates to an engine, and more particularly to an engine for a radio control model.

2. Description of Related Art

A conventional engine (1) of a radio control model in accordance with the prior art shown in FIG. 6 comprises chamber (2) defined therein, a piston (3) reciprocally movably received in the chamber (2), a crank (4) connected to a bottom of the piston (3), a T-shaped shaft (5) connected to the crank (4), a gear box (6) connected to the T-shaped shaft (5) and a seat (7) disposed on a outer periphery of the gear box (6). An electric tool (8) provides torsion into the gear box (6) for sequentially drive the T-shaped shaft (5), the crank (4) and the piston (4) for starting the engine (1). The operator must deeply insert a sparkler (9) into the engine (1) and electrically connecting to the spark plug (1A) to make the spark plug (1A) sparkle when starting the engine (1).

However, the operator must use one hand to operate the electric tool (8) and insert the sparkler (9) into the engine (1) with the other hand. It is very inconvenient and a bad connection may be occurred between the sparkler (9) and the spark plug (1A). As a result, the user may not successfully start the engine (1).

The present invention has arisen to mitigate and/or obviate the disadvantages of the conventional engine for a radio control model.

SUMMARY OF THE INVENTION

The main objective of the present invention is to provide an improved engine for a radio control model, which receives torsion and sparkling at the time.

To achieve the objective, the engine in accordance with the present invention comprises an input axle partially extending out of the engine. A drive device is laterally mounted to the engine for driving the input axle when starting the engine. The driving device includes a first casing and a second casing abutting each other and respectively made of insulating material. At least one drive element is rotatably mounted in the driving device for driving the input axle. A polygonal hole is longitudinally defined in the at least one drive element and adapted to be connected to an extra power source. A conducting ring is sleeved on the at least one drive element and a wire is electrically connected to the conducting ring and a spark plug that is mounted in the engine such that the spark plug sparkles and the input axle provides torsion at the same time for starting the engine.

Further benefits and advantages of the present invention will become apparent after a careful reading of the detailed description with appropriate reference to the accompanying drawings.

DETAILED DESCRIPTION OF THE INVENTION

Figure 1:
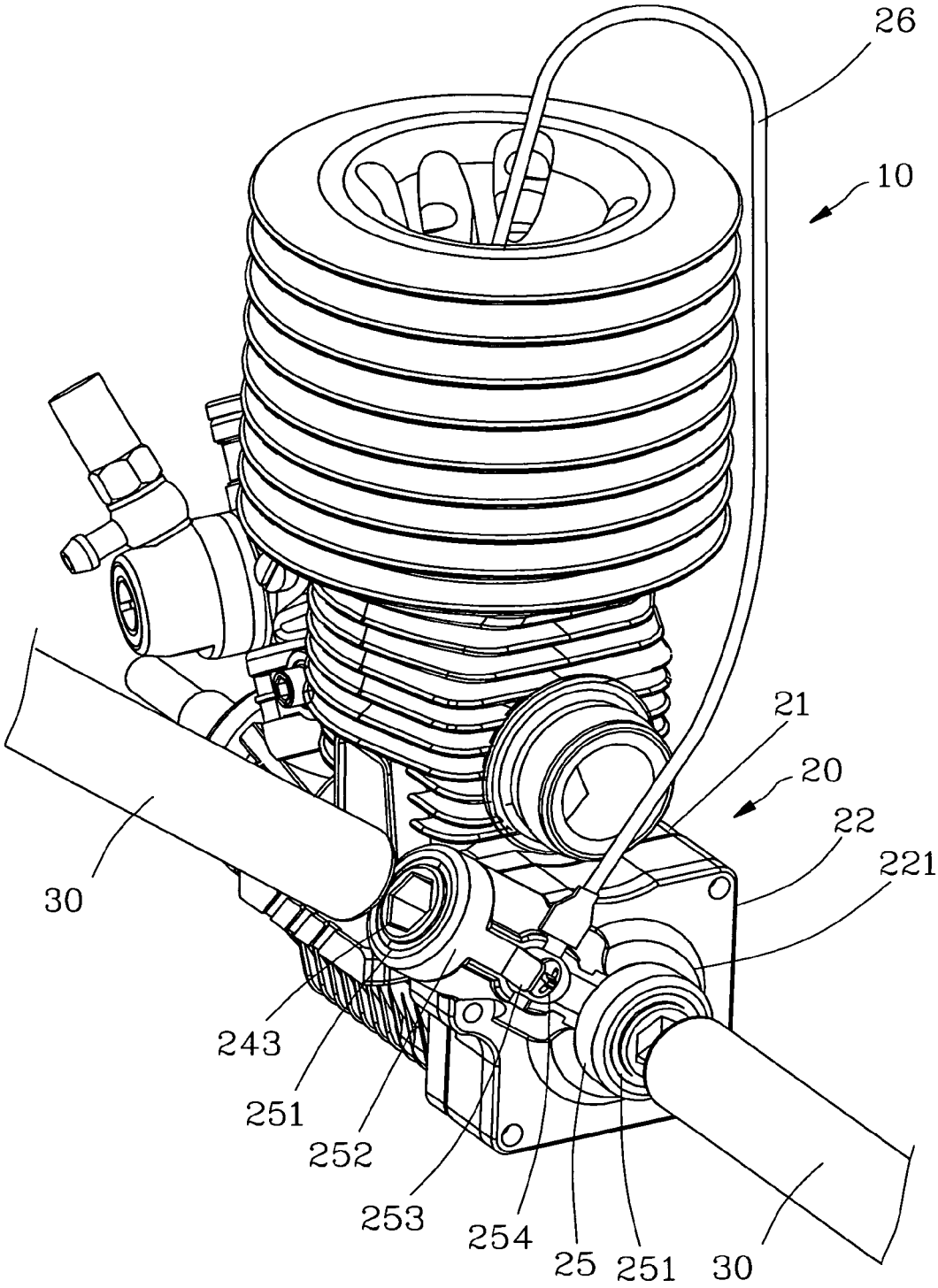
FIG. 1 is a perspective view of an engine for a radio control model in accordance with the present invention.
Figure 2:
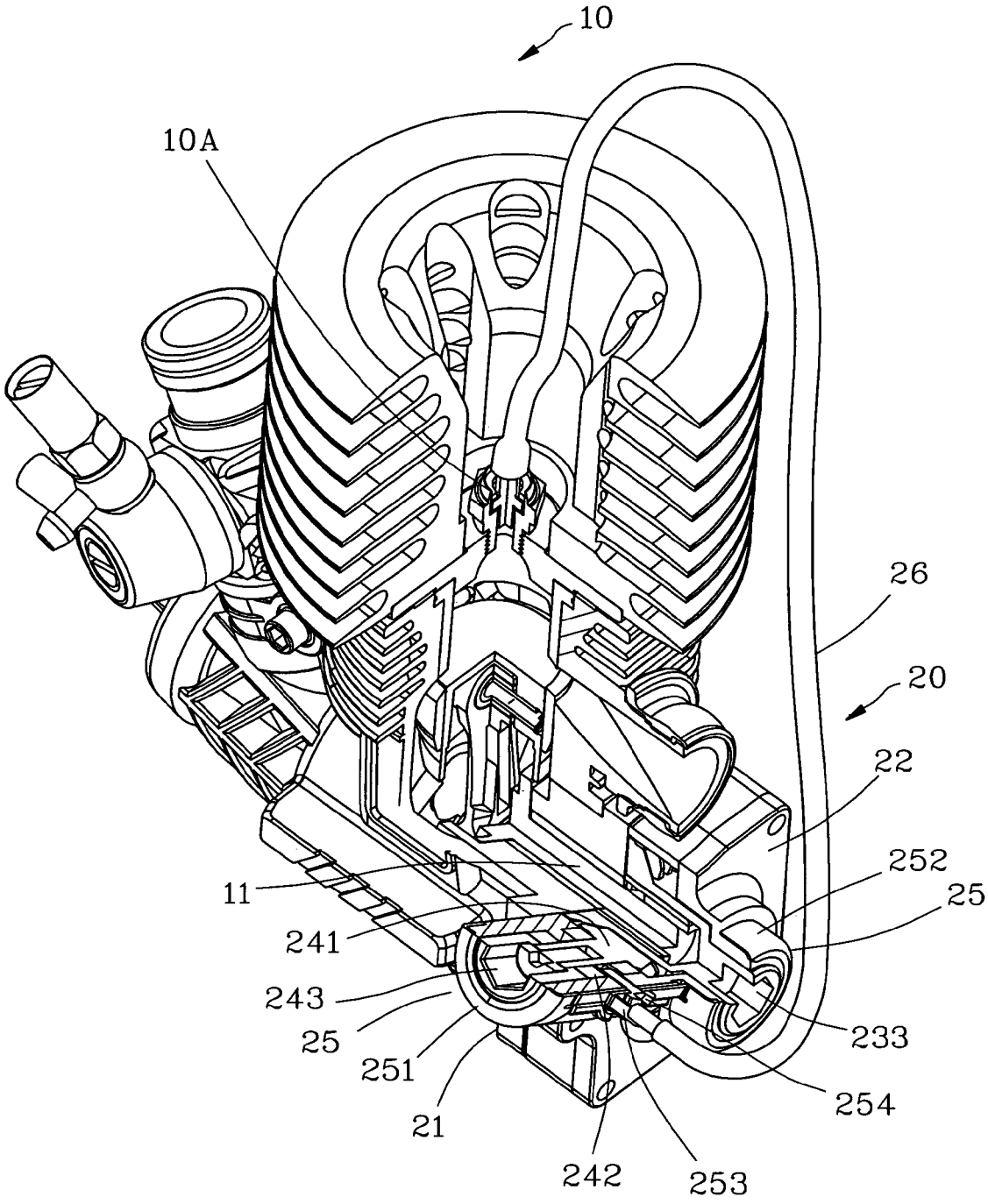
FIG. 2 is a perspective view of the engine in FIG. 1 in partial cross-section.
Figure 3:
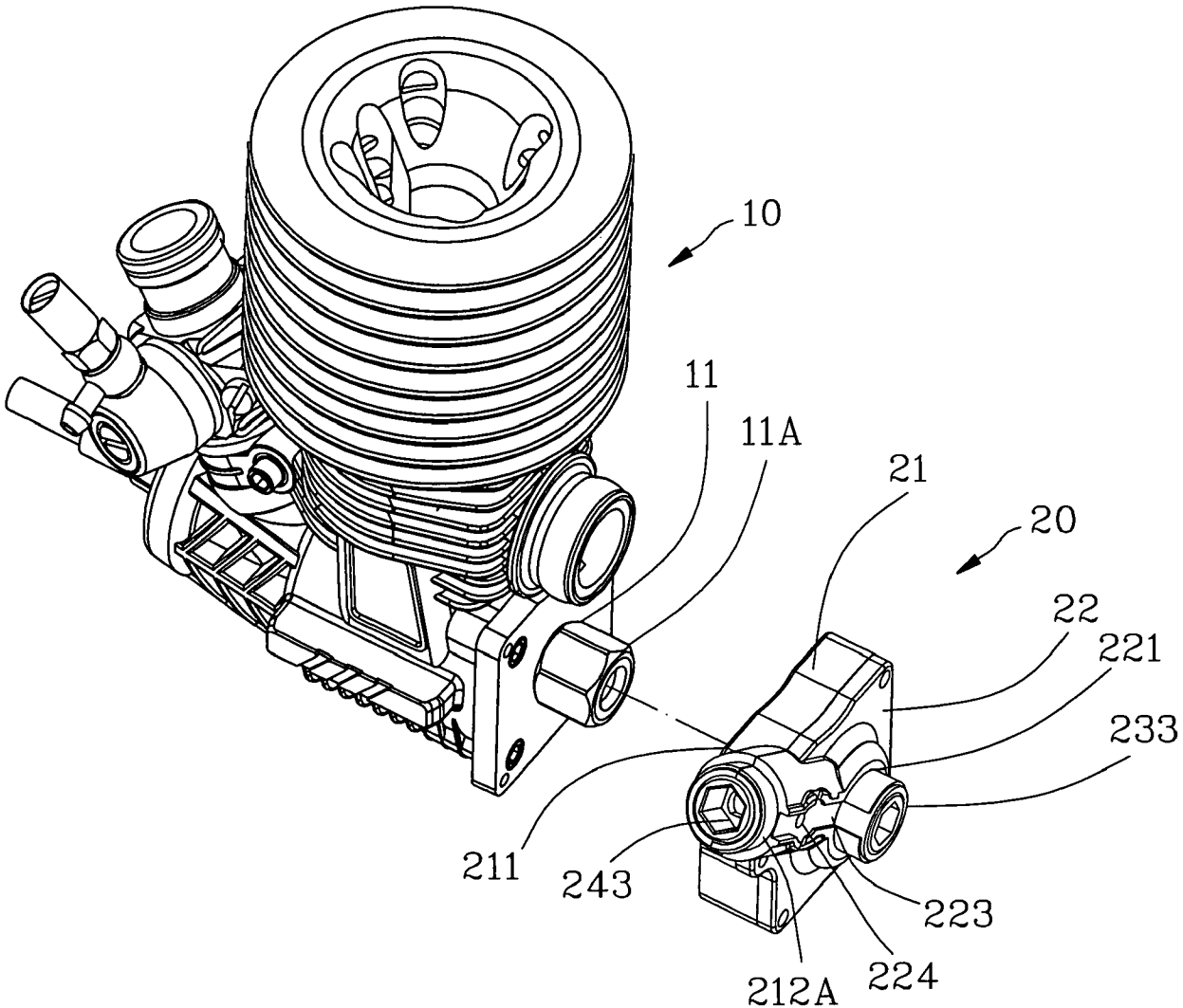
FIG. 3 is a partially exploded perspective view of the engine in FIG. 1.
Figure 4:
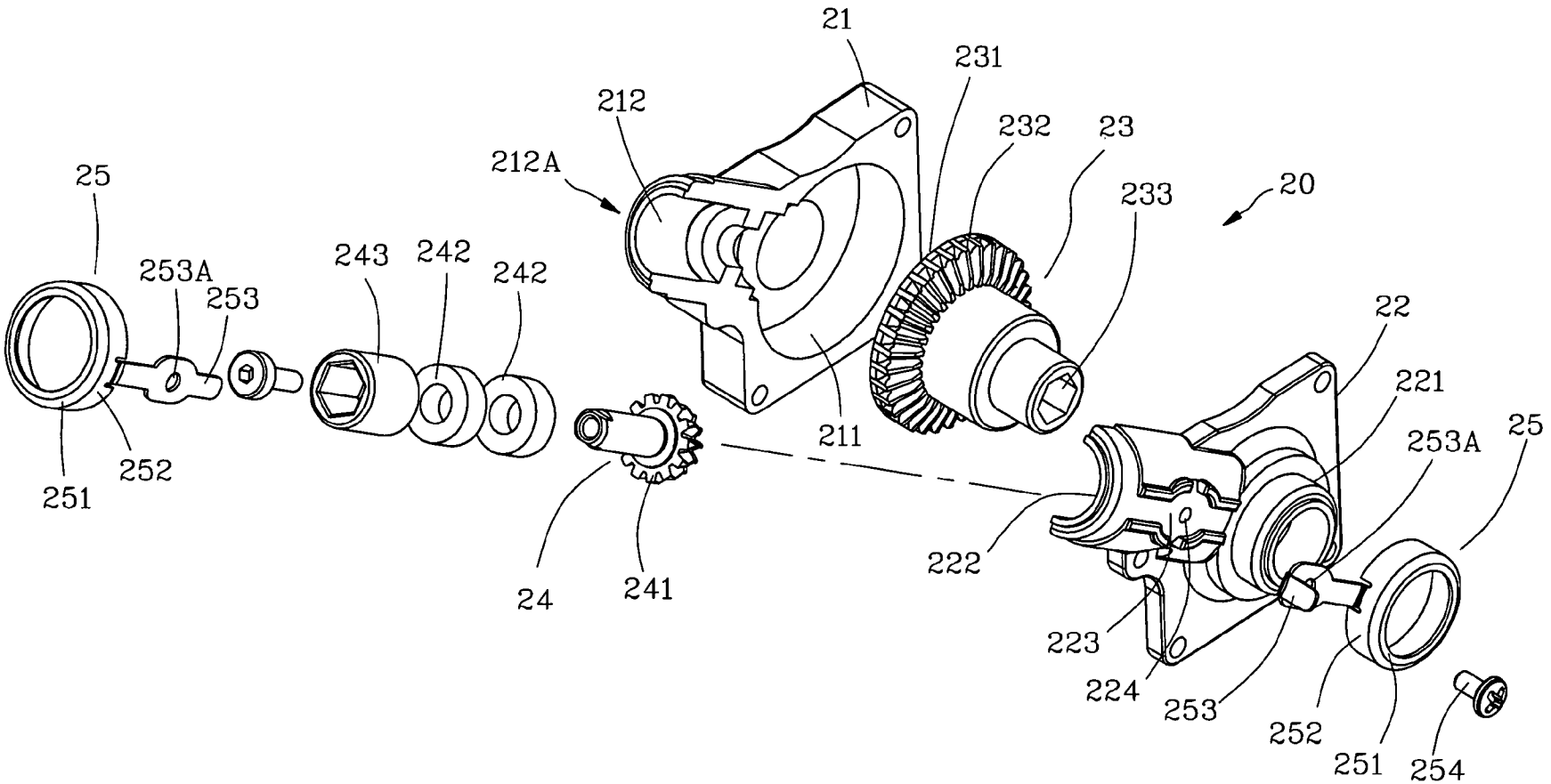
FIG. 4 is an exploded perspective view of a drive device in accordance with the present invention.

Referring to the drawings and initially to FIGS. 1-5, an engine (10) for a radio control model in accordance with the present invention comprises a driving device (20) laterally mounted thereon.

The engine (10) includes an input axle (11) mounted therein. The input axle (11) has a distal end (11A) extending out of the engine (10) and inserted into the driving device (20). The distal end (11A) of the input axle (11) has a hexagonal cross-section.

The drive device (20) includes a first casing (21) and a second casing (22) mounted to each other to defined a receiving space. The first casing (21) and the second casing (22) is made of insulated material, such as refractory plastic. The first casing (21) has a through hole (211) laterally defined therein. The first casing (21) has a first semicircle groove (212) defined therein and radially corresponding to the through hole (211). The second casing (22) has a collar (221) formed thereon and co-axially communicating with the through hole (211) in the first casing (21). The second casing (22) has a second semicircle groove (222) defined therein and radially corresponding to the collar (221). The first semicircle groove (212) and the second semicircle groove (222) completely communicate with each other to defined a tunnel (212A) when the first casing (21) and the second casing (22) are mounted to each other. A recess (223) is defined in an outer periphery of the second casing (22) and a threaded hole (224) is defined in a bottom of the recess (223).

A first drive element (23) and a second drive element (24) are rotatably mounted in the driving device (20) for driving the input axle (11) to start the engine (10). The first drive element (23) has a first end provided to securely receive the distal end (11A) of the input axle (11) and a ring of bevel gear (232) is formed and surrounds the first end of the first drive element (23). A polygonal hole (233) is longitudinally defined in a second end of the first drive element (23) for partially receiving a tool bit (31) of an electric tool (30), such as an electric screwdriver.

The second drive element (24) is partially and rotatably received in the tunnel (212A) and perpendicularly corresponds to the first drive element (23). The second drive element (24) includes a first end formed with a bevel gear (241) engaged with the ring of bevel gear (232) of the first drive element (23) such that the first drive element (23) and the second drive element (24) are synchronously operated. Two bearings (242) are sleeved on the second drive element (24) and a socket (243) is longitudinally connected to a second end of the second drive element (24), wherein the socket (243) is rotatably received in the tunnel (212A). The socket is adapted to be connected to a tool bit of an electric tool (30), such as an electric screwdriver.

In addition, two conducting rings (25) respectively surround the first drive element (23) and the second drive element (24). Each conducting ring (25) has a conduct side (251) and an outer periphery (252). Each conducting ring (25) has a terminal (253) extending therefrom and received in the recess (223). Each terminal (253) has a through hole (253A) defined therein. The two through holes (253A) and the threaded hole (224) align with one another such that the two terminals (253) are positioned when a bolt (254) extends through the two through holes (253A) and is screwed into the threaded hole (224). A wire (26) has two opposite ends respectively electrically connected to the two terminals (253) and a spark plug (10A) that is mounted in the engine (10). Consequently, the operator can rotate the input axle (11) by operating the first drive element (23) or the second drive element (24) and make the spark plug (10A) sparkle for starting the engine (10) at the same time and by one step.

Figure 5:
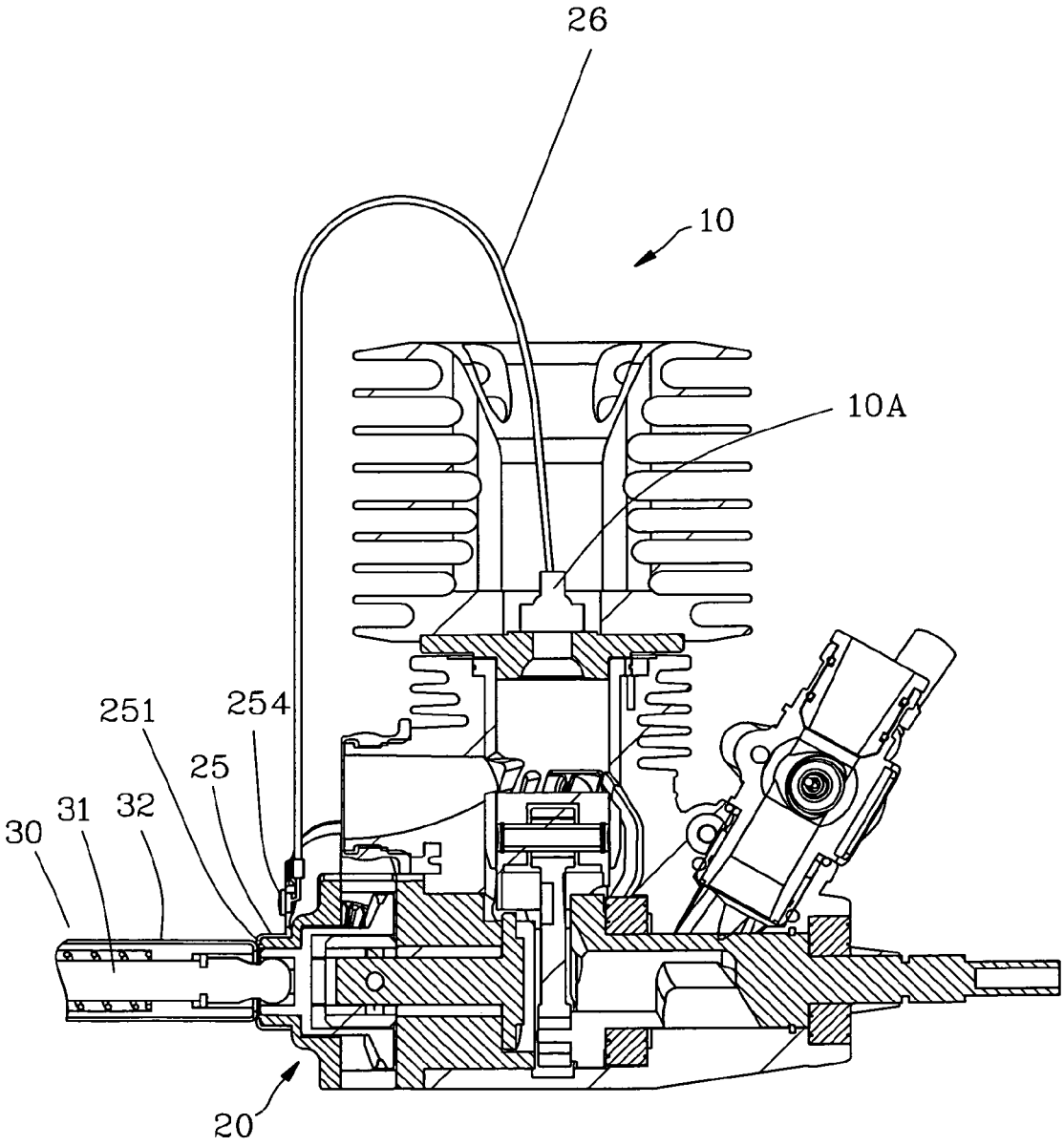
FIG. 5 is an operational view of the engine in accordance with the present invention.
Figure 6:
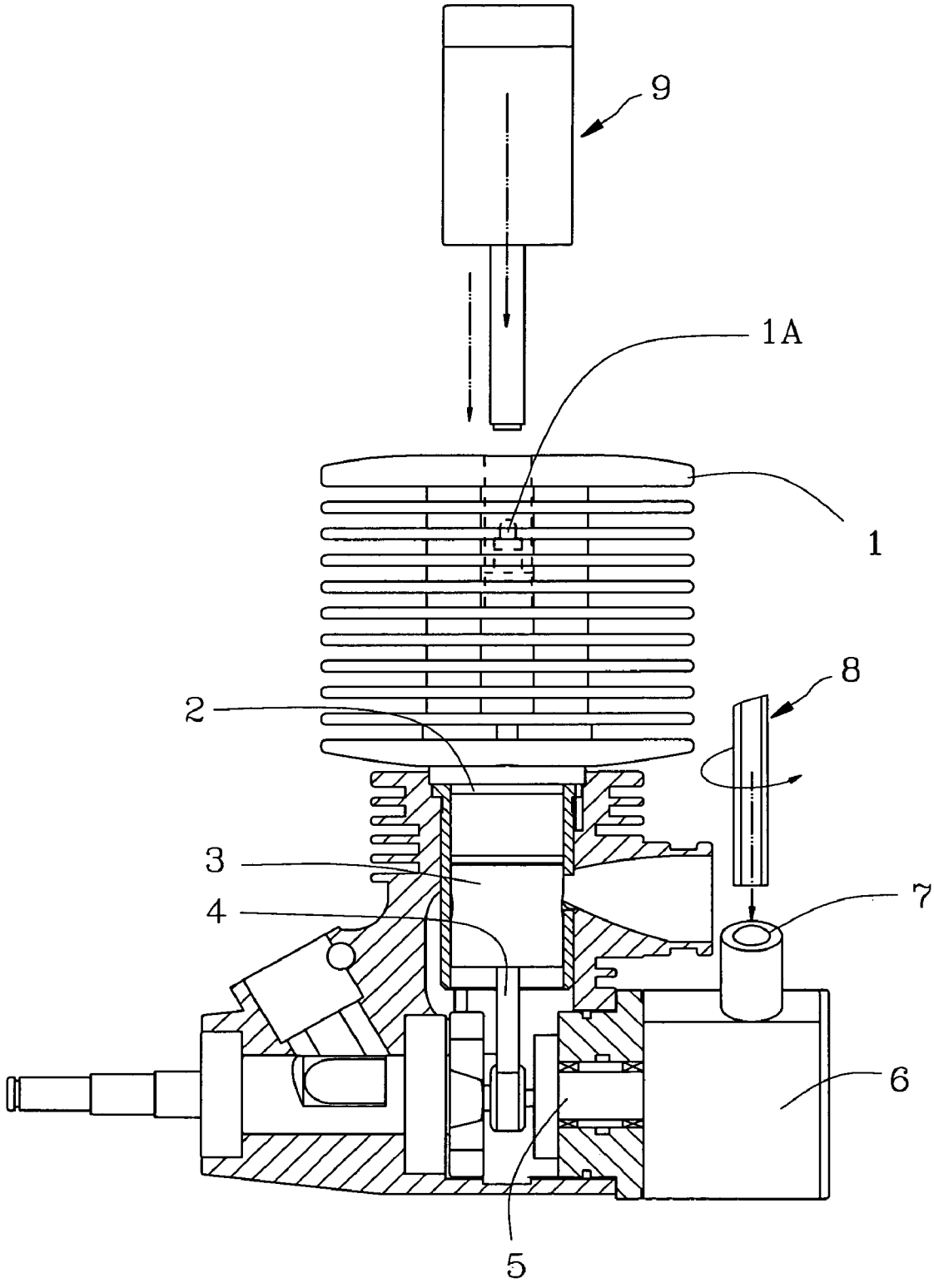
FIG. 6 PRIOR ART
FIG. 6 is an operational view of a conventional engine for a radio control model in accordance with the prior art.

With reference to FIGS. 1 and 5, when longitudinally inserting the electric tool (30) into the polygonal hole (233) and operating the electric tool (30), the tool bit (31) of the electric tool (30) quickly rotates the first drive element (23) with the input axle (11). As a result, the input axle (11) provides a torsion to start engine (10). In addition, the electric tool (30) has a conduct sleeve (32) rotated with the tool bit (31). The conduct sleeve (32) rubs against the conduct side (251) for generating electric current that is transmitted to the spark plug (10A) via the wire to make the spark plug (10A) sparkle. There is a same effect when operating the second drive element (24) because the bevel gear (241) is engaged to the ring of bevel gear (232) of the first drive element (23).

Although the invention has been explained in relation to its preferred embodiment, it is to be understood that many other possible modifications and variations can be made without departing from the spirit and scope of the invention as hereinafter claimed.

What is claimed is:

1. An engine for a radio control model, comprising an input axle partially extending out of the engine, a drive device laterally mounted to the engine for driving the input axle when starting the engine, the driving device including a first casing and a second casing abutting each other and respectively made of insulating material, at least one drive element rotatably mounted in the driving device for driving the input axle, a polygonal hole longitudinally defined in the at least one drive element and adapted to be connected to an extra power source, a conducting ring sleeved on the at least one drive element and a wire electrically connected to the conducting ring and a spark plug that is mounted in the engine such that the spark plug sparkles and the input axle provides torsion at the same time for starting the engine.

2. The engine as claimed in claim 1, wherein there are two drive elements respectively rotatably mounted in the driving device, the two drive elements perpendicularly corresponding to each other and engaged to each other via bevel gears.

3. The engine as claimed in claim 1, wherein the driving device is formed with at least one collar for pivotally and partially receiving the at least one drive element.

4. The engine as claimed in claim 1, wherein the conducting ring has a conduct side and an outer periphery formed thereon.

5. The engine as claimed in claim 1, wherein the second casing has a recess defined in an outer periphery thereof and a threaded hole defined in a bottom of the recess, the conducting ring having a terminal extending therefrom and received in the recess, the terminal having a through hole defined therein and aligning with the threaded hole such that the terminal is positioned when a bolt extends through the through hole and is screwed into the threaded hole.

* * * * *